US005213409A

United States Patent [19]

Fisher

[11] Patent Number: 5,213,409

[45] Date of Patent: May 25, 1993

[54] DECORATIVE LIGHT GRID

[76] Inventor: David B. Fisher, P.O. Box 128, Dewittville, N.Y. 14728

[21] Appl. No.: 853,055

[22] Filed: Nov. 18, 1991

[51] Int. Cl.[5] ..... F21P 2/00

[52] U.S. Cl. ..... 362/252; 362/238; 362/248; 362/812

[58] Field of Search ..... 362/238, 252, 812, 249, 362/123, 253, 806, 808, 121, 419, 807

[56] References Cited

U.S. PATENT DOCUMENTS

| | | | |
|---|---|---|---|
| 1,761,120 | 6/1930 | Graham et al. | 362/252 |
| 2,154,088 | 4/1939 | Guba | 362/812 |
| 4,769,749 | 9/1988 | Felski | 362/252 |
| 4,995,181 | 2/1991 | Wolf | 362/252 |

*Primary Examiner*—James C. Yeung
*Attorney, Agent, or Firm*—Howard J. Greenwald

[57] ABSTRACT

A grid suitable for preparing an illuminated display is disclosed. This grid contains a face material which has at least 0.6 discrete receptacles per square inch. Each of such receptacles contains two channels communicating with a larger, middle opening.

19 Claims, 5 Drawing Sheets

DECORATIVE LIGHT GRID

FIELD OF THE INVENTION

A light grid which may be utilized in conjunction with decorative string lights to produce decorative arrays is disclosed.

BACKGROUND OF THE INVENTION

Systems for making illuminated designs are known to the prior art. Thus, for example, U.S. Pat. No.2,154,088 of Raymond Guba discloses a sign comprised of a support made of wire fabric, the outer faces of which are substantially spaced from each other and are provided with openings arranged in rows.

One of the objects of the Guba patent is to provide a structure in which the illuminating elements are rigidly supported so that their axis will remain parallel to each other. In order to accomplish this, Guba provides ". . . a wire fabric the structure of which involves a substantial spacing between its opposite faces . . . (see column 1). Although Guba does not define the term ". . . substantial spacing . . . ," he indicates (at column 2 of the patent) that "The electric lamps may be any standard type of bulb 26 provided with a threaded base by means of which it is removably inserted into a lamp socket 27." It is clear from this teaching that, because the electric lamp sockets must fit within the openings in the wire mesh, the ". . . substantial spacing . . ." required in the Guba system must be as least as great as the diameter of the conventional lamp sockets which were available in 1937.

Because of this ". . . substantial spacing . . ." requirement, a problem is presented with the rigidity of the wire mesh structure. Guba describes his structure as being a "fabric." However, somewhat inconsistently, he also states that his "fabric" is ". . . sufficiently rigid to be self-sustaining" (see column 1). In order to obtain such rigidity, Guba appears to use a rather heavy wire to fabricate the wire fabric. Furthermore, the wire in Guba's system must be configured in a certain, rather complicated manner. In the first place, in Guba's fabric support, the openings must be formed by ". . . spiral strands extending in one direction and interengaging with each other, and by other spiral strands extending substantially at right angles thereto and interengaging with each other and the with the first ones . . ."(see column 1). In the second place, the spiral turns of wire must extend ". . . in the same direction . . . so that the loops of each strand interengage with the loops of both adjacent strands . . . (see column 1)" In the third place, ". . . each side of the openings through the fabric is formed by two arc-shaped sections of wire . . . one of which is a partial turn of a strand extending in one direction, and the other of which is a partial turn of a strand extending at right angles thereto" (see column 2). It should be noted, however, that nowhere in the Guba patent is there a disclosure of the particular metal wire which may be used to make Guba's wire fabric, or how one could weave such wire to obtain the desired structure.

Guba also does not specify the dimensions of his wire fabric. However, he does disclose that it is ". . . a structure of substantial thickness . . . (see column 1)" It is apparent that, because of such ". . . substantial thickness . . . ," such ". . . substantial spacing . . . ," and the use of a metal wire sufficiently thick to provide a ". . . self-sustaining . . ." structure, the Guba structure is also "substantially heavy."

It is an object of this invention to provide a lightweight grid structure which may be used to make decorative arrays with string lights.

It is another object of this invention to provide a grid structure which has sufficient rigidity so that it is self-sustaining.

It is yet another object of this invention to provide a grid structure comprised of a multiplicity of openings into which lights may be readily inserted and/or removed.

It is yet another object of this invention to provide a grid structure whose dimensions are not easily altered when such structure is in use.

It is yet another object of this invention to provide a grid structure which may readily be joined to other, similar grid structures to form a larger device.

It is yet another object of this invention to provide a grid structure which is comprised of means for mounting said structure to a surface.

It is yet another object of this invention to provide a grid structure which consists essentially of material which will not substantially degrade when exposed to ambient conditions.

It is yet another object of this invention to provide a grid structure which, when used in conjunction with string lights to produce an illuminated design, will produce a design which can readily be discerned at a wide range of distances.

It is yet another object of this invention to provide a grid structure which is relatively inexpensive to produce.

It is yet another object of this invention to provide a grid structure which is adapted to be used with a variety of differently sized string lamps.

It is yet another object of this invention to provide a grid structure which comprises a self-supporting frame structure.

It is another object of this invention to provide a system for making large, illuminated decorative arrays which is comprised of a multiplicity of modular, connectable grid units, each of which can be readily handled.

SUMMARY OF THE INVENTION

In accordance with this invention, there is provided a grid for preparing decorative, illuminated displays. This grid contains a frame, and mounted on such frame, an integral structure comprised of multiplicity of discrete receptacles for string lamps. Each of the receptacles is defined by an opening which communicates with a channel on each side of the opening; the maximum dimension of the opening is larger than the width of either channel.

BRIEF DESCRIPTION OF THE DRAWINGS

The present invention will be more fully understood by reference to the following detailed description thereof, when read in conjunction with the attached drawings, wherein like reference numerals refer to like elements, and wherein:

FIG. 7 is a sectional view of the receptacle of

FIG. 6, taken along lines 7—7, illustrating the configuration of such receptacle prior to the time a light bulb assembly is inserted into it;

DESCRIPTION OF THE PREFERRED EMBODIMENTS

Figure 1:
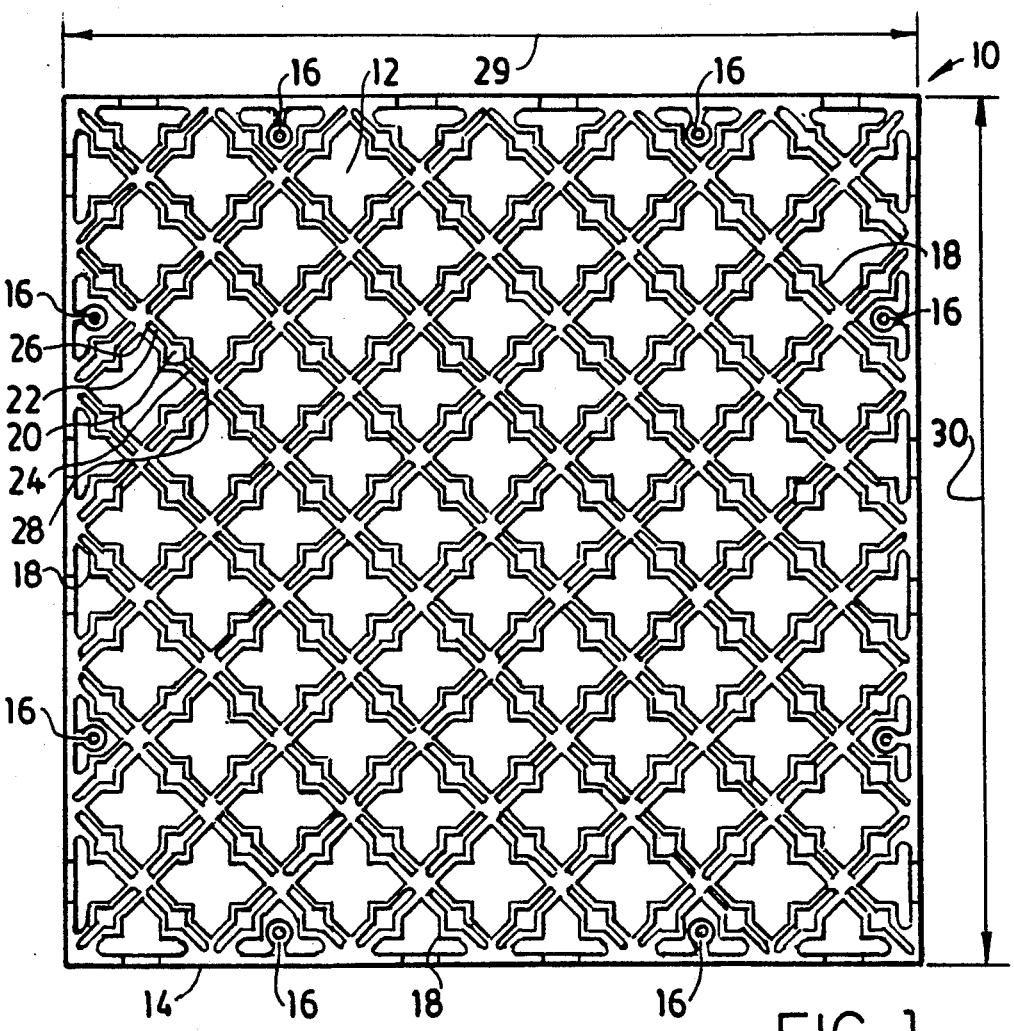
FIG. 1 is a top view of one preferred grid of the present invention.

FIG. 1 illustrates on preferred embodiment of the grid 10 of this invention. This grid 10 is preferably comprised of face 12 and frame 14. In one preferred embodiment, the grid 12 also comprises means 16 for removably attaching grid 10 to a surface.

The grid 10 preferably consists essentially of plastic, and preferably consists of plastic material which can readily be injection molded. As is known to those skilled in the art, one may use thermoplastic material, thermosetting material, and the like.

By way of illustration and not limitation, one may use polyethylene, polypropylene, styrene resins, etc.

In one preferred embodiment, the grid 10 consists essentially of polyethylene. As is known to those skilled in the art, these materials are polyolefin fibers derived from ethylene by polymerization.

In one embodiment, polyethylene with a density of from about 0.91 to about 0.959 is used to make the grid 10 of this invention.

In one preferred embodiment, the grid 10 consists essentially of polyethylene and an effective amount of an ultraviolet light stabilizer. These stabilizers are well known to those skilled in the art and are described, e.g., on pages 192–196 and 546–548 of the mid-October Issue of Modern Plastics, entitled "Encyclopedia '92" (McGraw Hill Company, Highstown, N.J.).

In one embodiment, the ultraviolet stabilizer is a benzophenone, such as, e.g., 2,4-Dihydroxy-benzophenone, 2-Hydroxy-4-acrylooxyloxyethoxybenzonpenone, "ULVINYL 490" (sold by B.A.S.F.), "MARK 1535" (sold by Argus), "PERMYL B100" by Ferro).

In another embodiment, the ultraviolet stabilizer is a benzotriazole such as, e.g., 2(2'-Hydroxy-5'-methyhlphenyl)benzotriazole, "TINUVIN 327" (sold by Ciba-Geigy), "CYASORB UV 5411" (sold by American Cyanamid), and the like.

In another embodiment, the ultraviolet stabilizer is a salicylate such as, e.g., t-butyl phenyl salicylate.

In yet another embodiment, the ultraviolet stabilizer is an organic nickel compound as, e.g., nickel bis (octyl phenol sulfide), nickel dibutyldithiocarbamate, "MARK 1306A" (sold by Argus), and the like.

In yet another embodiment, the ultraviolet stabilizer is a monobenzoate, such as, e.g., resorcinol monobenzoate.

Other ultraviolet stabilizers, well known to those in the art, also may be used. In one embodiment, one may use from about 0.001 to about 10 weight percent of such stabilizer in the grid composition.

The grid 10 of this invention is preferably prepared by conventional injection molding techniques. These techniques are described, e.g., on pages 267–281 of said Modern Plastics Encyclopedia.

The grid 10 of this invention is comprised of a multiplicity of resilient receptacles 18. Referring again to FIG. 1, it will be seen that each of said receptacles is comprised of a light assembly enclosure 20, a first channel 22 communicating with enclosure 20, and second channel 24 communicating with enclosure 20, a first end 26 closing said channel 22, and a second end 28 closing channel 24. Thus, each of said receptacles 18 is a discrete structure enclosing a finite space defined by said ends 26 and 28, said channels 22 and 24, and said enclosure 20.

In order to obtain the proper degree of image resolution when some of such channels are filled with light bulb assemblies, a certain minimum density of such receptacles 18 must be present in grid 10. In general, there must be at least about 0.6 of the receptacles 18 per square inch of grid 10. It is preferred that there be at least about 0.8 receptacles 18 per square inch of grid 10. In an even more preferred embodiment, there are at least about 1.0 receptacles 18 per square inch of grid 10.

In determining the number of receptacles per square inch of grid 10, one may measure the length 30 and the width 32 of grid 10, convert these measurements into square inches, and multiply the length and width so measured to obtain the cross-sectional area (in square inches) of grid 10. In cases where the cross-sectional shape of grid 10 is not rectilinear, one may determine its cross-sectional area by conventional geometric methods.

After determining the cross-sectional area of grid 10, one then may determine the number of receptacles 18 present in the face of such grid by counting them. Dividing the cross-sectional area into this number will yield the number of receptacles per square inch of grid 10.

In the preferred embodiment illustrated in FIG. 1, there are about 1.0 receptacles 18 per square inch of grid 10.

Figure 2:
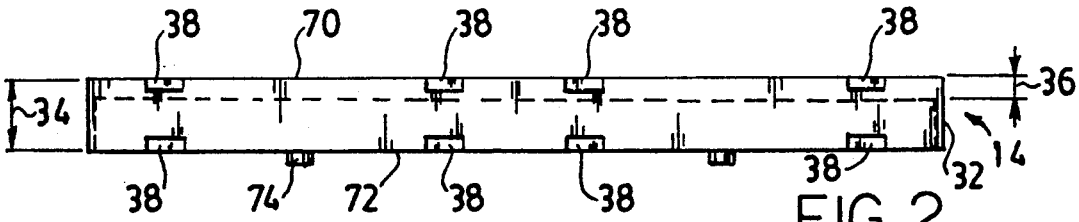
FIG. 2 is a side view of the grid of FIG. 1.

FIG. 2 is a side view of the grid 10 of FIG. 1. Referring to FIG. 2, it will be seen that the frame 14 preferably extends around the entire perimeter of grid 10 and is comprised of a downwardly-extending lip 32 which has a height 34 which is greater than the thickness 36 of face 12 of grid 10. In general, height is at least 2.0 as great as thickness 36. In one preferred embodiment, height 34 is at least about 1.0 inches, and thickness 36 is less than about 0.5 inches.

Referring again to FIG. 2, it will be seen that lip 32 is preferably comprised of multiplicity of indentations 38 which are adapted to receive a connecting clip (not shown in FIG. 2).

Figure 4:
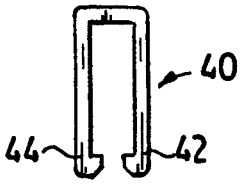
FIG. 4 is an end view of the connecting clip of FIG. 3.
Figure 3:
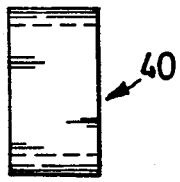
FIG. 3 is side view of a connecting clip which may be used to join the grid of FIG. 1 to another such grid.

FIG. 3 is side view of a connecting clip 40 which may be used to join two of the grids 10. FIG. 4 is an end view of clip 40, illustrating prongs 42 and 44 which may be separated in order to fit clip 40 over the lips 32 of two of the grids 10.

Figure 5:
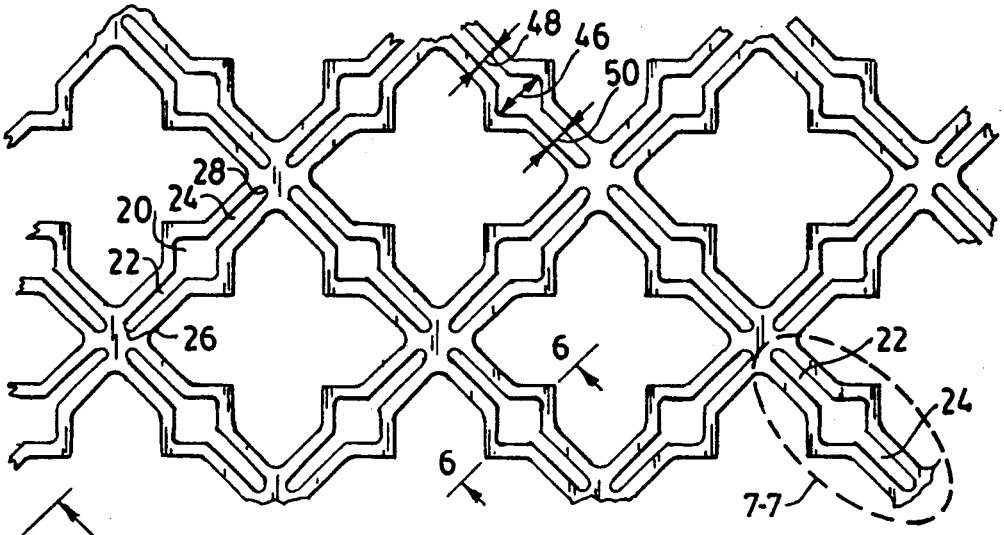
FIG. 5 is an exploded top view of the grid of FIG. 1.

FIG. 5 is an enlarged view of a portion of face 12 of FIG. 1. Referring to FIG. 5, it will be seen more clearly that each of receptacles 18 defines a closed space comprised of first channel 22, which communicates with enclosure 20, which in turn communicates with second channel 24. Each of these receptacles is a discrete structure, terminating in a first end 26, and a second end 28.

The enclosure 20 has a maximum dimension 46 which is substantially larger than the width 48 of channel 22 and the width 50 of channel 24. In general, the maximum dimension 46 of enclosure 20 is at least about 1.4 times as great as the width 48 or the width 50.

In the embodiment illustrated in FIG. 5, enclosure 20 has a substantially hexagonal shape. It will be apparent to those skilled in the art, however, that enclosure 20 may also have other cross-sectional shapes such as, e.g., a triangular shape, an arcuate shape, a rectilinear shape, an irregular shape, and the like.

Figure 6:
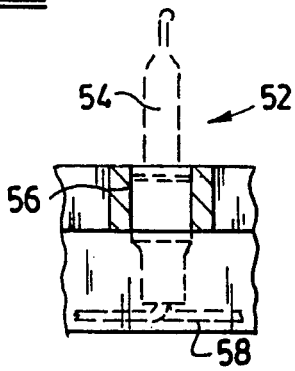
FIG. 6 is a sectional view of a receptacle of the grid of FIG. 6, taken along lines 6—6, illustrating a light bulb disposed in it.

In the preferred embodiment illustrated in FIG. 6, four of the discrete receptacles 18 are joined together to form a square in which an enclosure 20 is present in substantially the middle of each side of the square. It will be apparent to those skilled in the art that other arrangements also may be used. Thus, for example, the receptacles 18 may form triangular shapes, circular shapes, rectangular shapes, pentagonal shapes, hexagonal shapes, and the like. It is preferred, however, that the shape formed by the receptacles 18 form a shape whose geometry is repeated again and again in the grid pattern.

The receptacles 18 in grid 10 are resilient, that is, when a bulb assembly 52 (see FIG. 6) is inserterted into a receptacle 18, the walls of such receptacle 18 will readily separate in order to accomodate such insertion and, thereafter, will spring hold the bulb assembly 52 firmly Bulb assembly 52 is often referred to as "Christmas Tree light," or a "string bulb," and is well known to most everyone who ever has decorated a Christmas tree. Generally, one may buy a string of bulbs comprised of electrical cord, from about 25 to about 200 bulbs, and an electrical plug at both ends. By way of illustration, these bulbs are sold by the General Electric Company (of Nela Park, Cleveland, Ohio) as "STRING-A-LONG" light set.

Referring again to FIG. 6, it will be seen that bulb assembly 52 is preferably comrpised of bulb 54, socket 56, and electrical cord 58.

Figure 7:
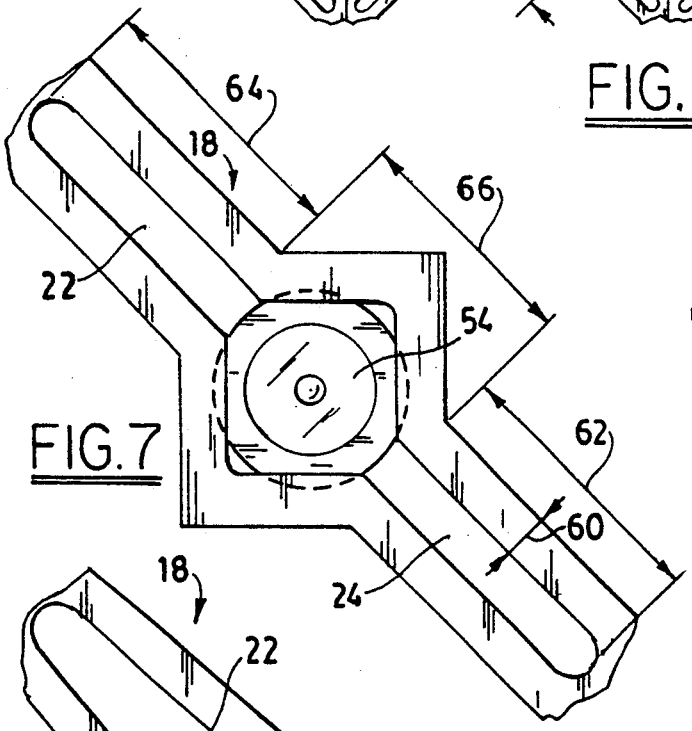
Figure 8:
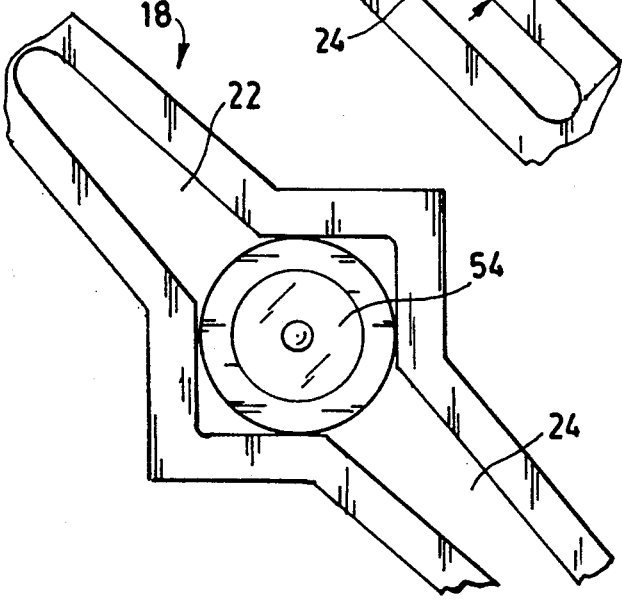
FIG. 8 is a partial top view of the receptacle of FIG. 6, illustrating the configuration of such receptacle as a light bulb assembly is being inserted into it.

FIGS. 7 and 8 illustrate receptacle 18 in two positions. In the position depicted in FIG. 7, the receptacle 18 is in its substantially unexpanded closed position. By comparison, in the position depicted in FIG. 8, in which which a bulb assembly 52 is being inserted into receptacle 18, the receptacles 18 is in its substantially expanded position.

Referring to FIG. 7, and in the preferred embodiment illustrated therein, it will be seen that, in its unexpanded state, it is preferred that each of the walls of receptacle 18 have a thickness 60 which is from about 0.03 to about 0.25 inches and, more preferably, from about 0.06 to about 0.18 inches. It is also preferred that the length 62 of channel 24, and the length 64 of channel 22, each is at least about 1.1 times as great as the length 66 of enclosure 20.

Figure 9:
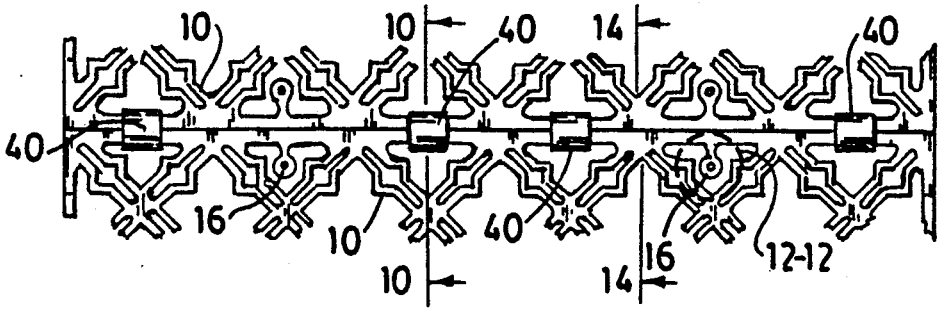
FIG. 9 is a partial top view of the adjacent grids of FIG. 1 being joined to each other.

FIG. 9 illustrates two of the grids 10 of FIG. 1 being joined by clip 40.

Figure 10:
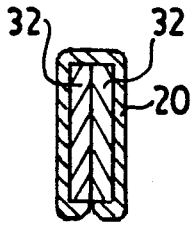
FIG. 10 is a sectional view of one of the clip assemblies of FIG. 9 joining such grids together, taken along lines 10—10.

FIG. 10 is a sectional view of one of the clips 40 of FIG. 9, taken along lines 10—10. It will be seen that clip 40 fits over the indentations 38 (not shown in FIG. 10, but see FIG. 2) of lips 32 and thus clamps the adjacent, downwardly-extending lips 32 of adjacent grids 10 together.

Figure 11:
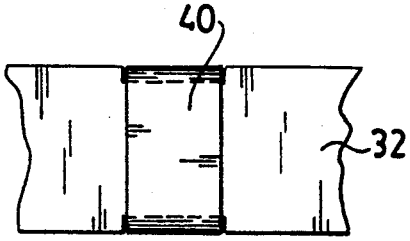
FIG. 11 is a side view of the clip depicted in FIG. 10.

FIG. 11 is a side view of clip 40, showing it in place on one of the lips 32.

Figure 12:
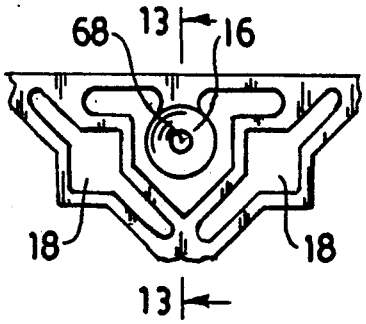
FIG. 12 is a partial top view of one attachment means for securing the grid assembly of FIG. 1 to a surface.

FIG. 12 is aparital sectional view of one of the downwardly-extending attachment means 16. It will be seen that, in the preferred embodiment depicted in FIG. 12, that attachment means 16 is comprised of an orifice 68 through which a fastener (not shown in FIG. 12) may be inserted. Referring to FIG. 2, it will be seen that the orifice 68 preferably extends from the top 70 of grid 10 to beneath the bottom 72 of lip 32, ending in bottom portion 74.

Figure 13:
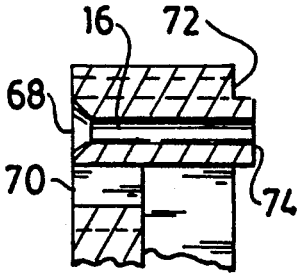
FIG. 13 is a side view of the attachment means of FIG. 12.

FIG. 13 is a sectional view of the attachment means 16 of FIG. 12, taken along lines 13—13.

Figure 14:
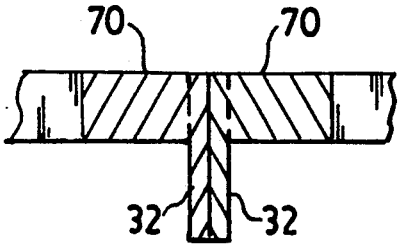
FIG. 14 is a partial sectional view of the joined grids of FIG. 9, taken along lines 14—14.

FIG. 14 is a sectional view of the joined grid assembly of FIG. 9, taken along lines 14—14.

Figure 15:
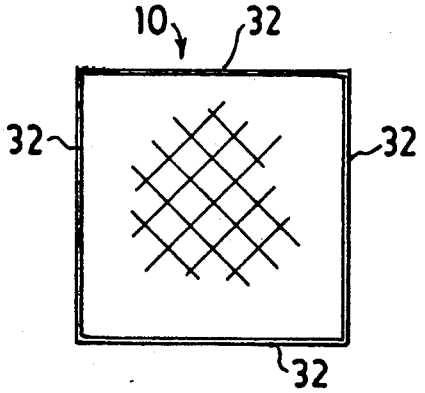
FIG. 15 is a schematic representation of one of the grids of FIG. 1.
Figure 16:
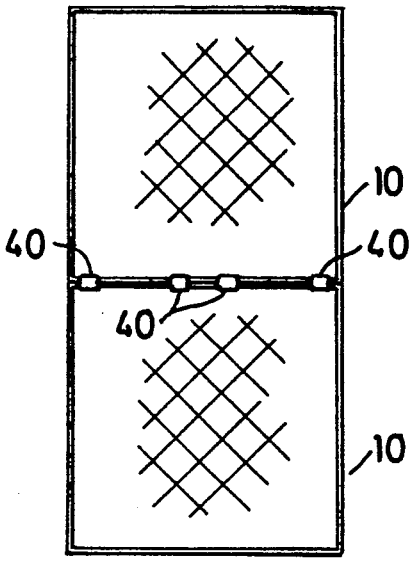
FIG. 16 is a schematic representation illustrating how two of the grids of FIG. 1 are joined together.
Figure 17:
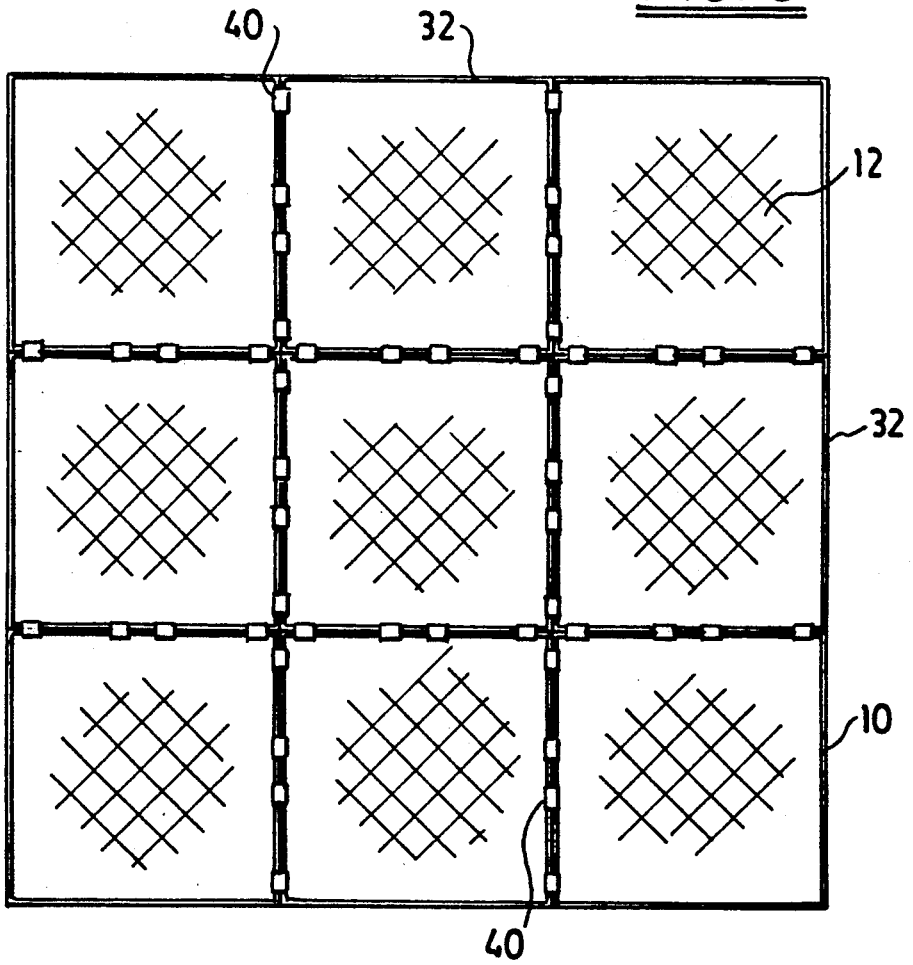
FIG. 17 is a schematic representation illustrating how nine of the grids of FIG. 1 may be joined together.

FIG. 15 is a schematic representation of grid 10, comprising downwardly-extending lip 32 around the entire perimeter of such grid. FIG. 16 schematically illustrates two of such grid 10's joined together by clips 32. FIG. 17 illustrates nine of such grid 10's joined together by clips 32. It will be apparent to those skilled in the art that a wide variety of diverse shapes may be constructed from the grids 10.

Although each of the grids 10 depicted in FIGS. 15, 16, and 17 have a substantially square cross-section, it will be apparent that such grids may come in many different shapes such as, e.g., rectangles, triangles, circles, stars, irregular shapes. Thus, in one embodiment, a multiplicity of grids 10 could be provided which, when fastened together, form the shape of an animal, or a Christmas tree, or a circle, etc.

Figure 19:
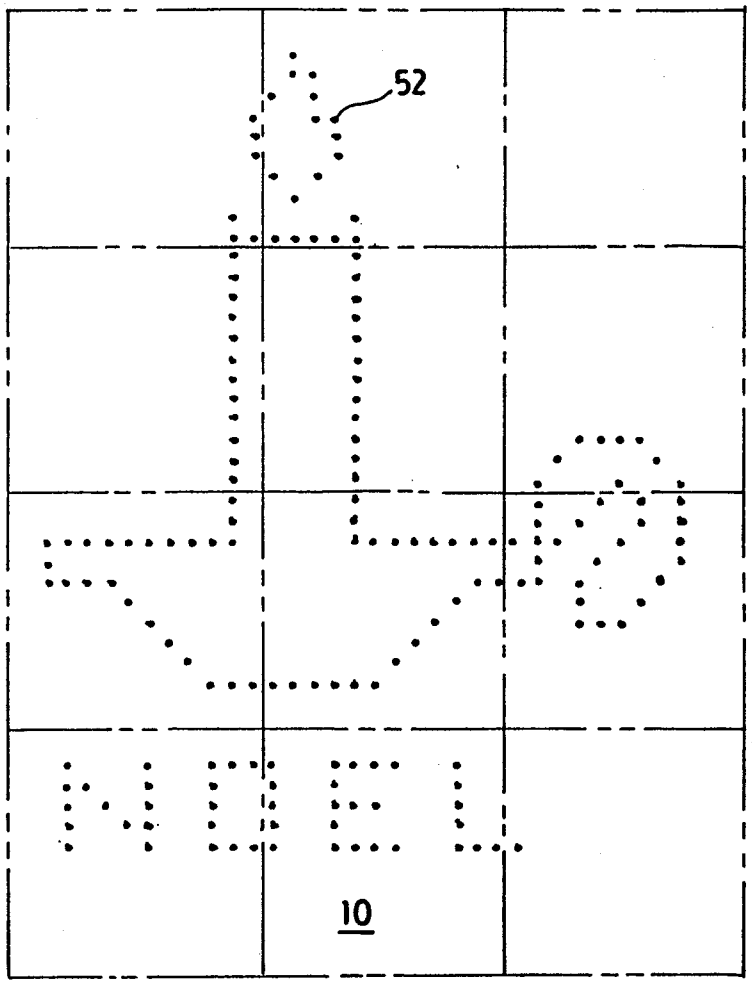
FIG. 19 is a top view of another decorative array formed with the grids of this invention.
Figure 18:
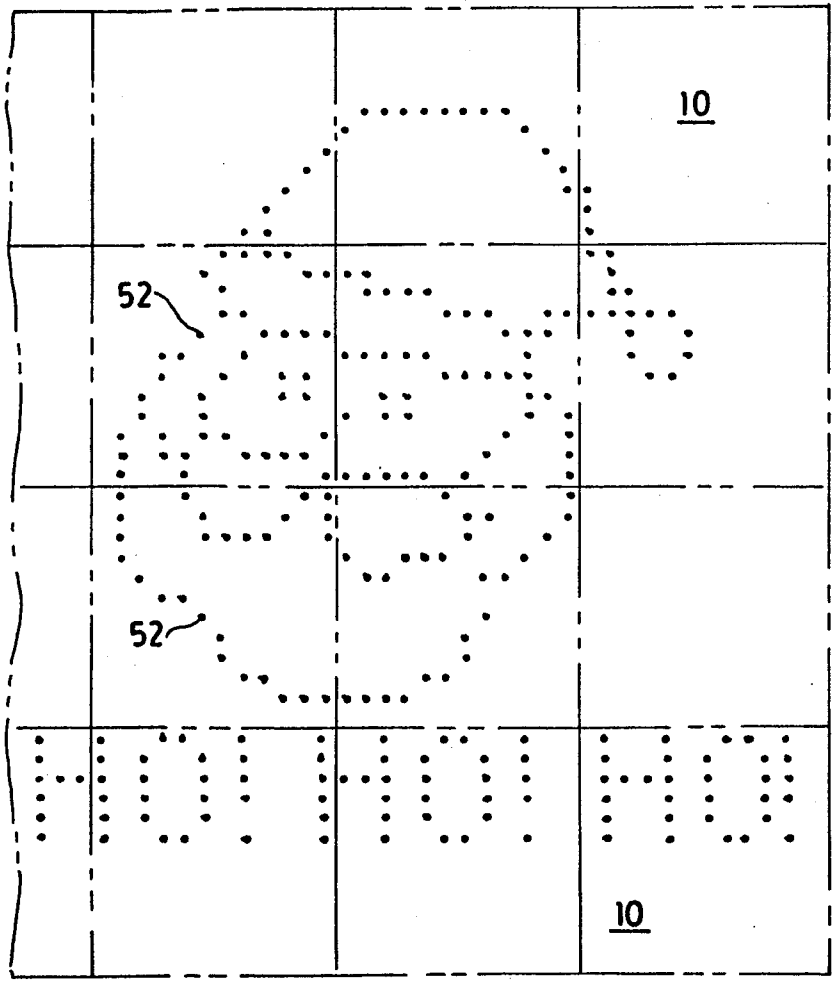
FIG. 18 is top view of a multiplicity of grids of FIG. 1 joined together with a decorative pattern formed in such grids by the use of string lights.

FIGS. 18 and 19 illustrate some of the types of designs which are possible with the use of grid 10 and light assembly 52. It will be apparent that applicant's system furnishes one a substantial degree of flexibility in preparing various designs. There are substantially an infinite number of possibilities.

Another embodiment of the invention

In another embodiment of the invention, not shown, the receptacles 18 are formed in a flexible mesh screen by conventional techniques. Thus, for example, the screen may be formed by the technique disclosed in U.S. Pat. No. 2,154,088 of R. J. Guba, the disclosure of which is hereby incorporated by reference into this specification. Thus, for example, knitted wire mesh is available in woven metal wire of most alloys (see, e.g., page 11-32 of Robert H. Perry et al.'s "Chemical Engineers' Handbook,38 Fifth Edition (McGraw-Hill Book Company, N.Y., 1977). Thus, for example, one may use plastic mesh, which also is readily available. Thus, for example, one may use coated fiber glass yarn solar screening (see, e.g., A.S.T.M. D4028).

The mesh used in this process is comprised of at least about 0.6 receptacles 18 per square inch. Once the light assemblies 52 have been inserted into the receptacles 18, the assembly thus formed may be mounted in a suitable frame.

In the embodiments heretofore discussed in this specification, the grids 10 generally have a uniform distribution of receptacles 18. In another embodiment, not shown, the density of the receptacles 18 in some portions of the grid 10 is not equal to the density of the receptacles 18 in other portions of the grid 10. Thus, in one aspect of this embodiment, the grids 10 are joined together to form a five-pointed star, the inner portions of which have a relatively high density of receptacles 18 and the outer portions of which are solid and contain no receptacles 18.

Applicant has heretofore illustrated one means of joining different grids 10, by the use of clip 40. It will be apparent to those skilled in the art that other means of connecting various sizes, shapes, and types of grids 10 may also be used. Such means may result in pivotal connections, and/or adjustable connections, and/or permanent connections, and the like. Thus, by way of illustration, one may make such connection by adhesive means, by friction fits, by various fasteners, etc.

In one preferred aspect of this embodiment, at least two of the grids 10 are pivotally connected to each other by conventional means.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A grid for preparing an illuminated display, wherein said grid is comprised of a face material, and wherein:

(a) said face material is comprised of at least about 75 weight percent of plastic material;

(b) said face material is comprised of at least about 0.6 receptacles per square inch of said face material, wherein:

1. each of said receptacles defines an opening, and each of said openings is comprised of a first channel, a light-assembly enclosure, and a second channel, wherein:

(a) said first channel communicates with said light-assembly enclosure, (b) said light assembly enclosure communicates with said second channel, (c) said light-assembly enclosure has a maximum dimension which is greater than the maximum width of said first channel, (d) said light-assembly enclosure has a maximum dimension which is greater than the maximum width of said second channel;

2. each of said receptacles is defined by a wall with a thickness of from about 0.03 to about 0.25 inches;

3. the length of said first channel is at least about 1.1 times as great as the length of said light-assembly enclosure; and 4. the length of said second channel is at least about 1.1 times as great as the length of said light-assembly enclosure.

2. The grid of claim 1 wherein the face material is mounted in a frame.

3. The grid as recited in claim 2, wherein said face material is an integral, substantially rigid structure.

4. The grid as recited in claim 3, wherein each of said receptacles defines an opening extending from the top of said face material to the bottom of said face material.

5. The grid as recited in claim 4, wherein said light-assembly enclosure has a maximum dimension which is at least 1.4 times as great as the maximum width of said first channel.

6. The grid for preparing an illuminated display as set forth in claim 6 consisting of a first grid and a second grid and means for attaching said first grid to said second grid to said second grid.

7. The grid as recited in claim 6, wherein said grid is comprised of means for attaching said grid to another grid for preparing an illuminated display.

8. A composite structure for preparing an illuminated display comprised of a first grid as recited in claim 6, a second grid as recited in claim 6, and means for attaching said first grid to said second grid.

9. The composite structure as recited in claim 8, wherein said means for attaching said first grid to said second grid is a clip.

10. The composite structure as recited in claim 8, wherein said first grid is pivotally connected to said second grid.

11. An illuminated display comprised of the composite structure as recited in claim 8 and a multiplicity of string lights disposed within said receptacles of said grid.

12. The grid as recited in claim 6, wherein said grid is comprised of an effective amount of an ultraviolet light stabilizer.

13. The grid as recited in claim 12, wherein said plastic is polyethylene.

14. The grid as recited in claim 6, wherein said frame is defined by a continuous, downwardly-extending lip.

15. The grid as recited in claim 14, wherein said downwardly-extending lip is comprised of a multiplicity of indentations.

16. The grid as recited in claim 5, wherein the number of said receptacles per square inch of said grid is substantially the same in every portion of said grid.

17. The grid as recited in claim 5, wherein the number of said receptacles per square inch of said grid is different in different portions of said grid.

18. The grid as recited in claim 1, wherein said face material consists essentially of flexible plastic mesh material.

19. The grid as recited in claim 18, wherein said flexible plastic mesh material is mounted to a frame.

* * * * *